US007183985B2

(12) United States Patent
Tseng

(10) Patent No.: US 7,183,985 B2
(45) Date of Patent: Feb. 27, 2007

(54) PLANAR INVERTED-F ANTENNA

(75) Inventor: Kuo-Hua Tseng, Meinong Township, Kaohsiung County (TW)

(73) Assignee: Universal Scientific Industrial Co., Ltd., Nan-Tou (TW)

( * ) Notice: Subject to any disclaimer, the term of this patent is extended or adjusted under 35 U.S.C. 154(b) by 12 days.

(21) Appl. No.: 11/176,317

(22) Filed: Jul. 8, 2005

(65) Prior Publication Data

US 2007/0008221 A1 Jan. 11, 2007

(51) Int. Cl.
*H01Q 1/24* (2006.01)

(52) U.S. Cl. ..... 343/702; 343/846

(58) Field of Classification Search ..... 343/702, 343/700 MS, 846
See application file for complete search history.

(56) References Cited

U.S. PATENT DOCUMENTS 6,466,170 B2 * 10/2002 Zhou ..... 343/700 MS
6,738,023 B2 5/2004 Scott et al.
6,850,200 B2 2/2005 Tracy et al.
6,958,732 B2 * 10/2005 Yuanzhu ..... 343/702
6,982,673 B2 * 1/2006 Yuanzhu ..... 343/700 MS
2002/0101381 A1 * 8/2002 Segerstedt ..... 343/702
2003/0107881 A1 * 6/2003 Muramatsu et al. ..... 361/818

* cited by examiner

*Primary Examiner*—Hoang V. Nguyen
(74) *Attorney, Agent, or Firm*—Rosenberg, Klein & Lee

(57) ABSTRACT

A planar inverted-F antenna has advantages of easy manufacture, a stable structure and automatic assembly. The antenna is fixed onto a PCB and has a grounding element that is made of conductive material and is plate-shaped, a radiation element formed from a plate-shaped metal plate, a signal link element and at least one supporting leg. The radiation element has a grounding leg that electrically connects with the grounding element. The signal link element electrically connects with the radiation element to a circuit for wireless signal transmission and reception. The at least one supporting leg is downwardly bent from an edge of the radiation element far from the grounding leg and is fixed onto the PCB. The supporting leg and the grounding leg support the radiation element together.

6 Claims, 8 Drawing Sheets

PLANAR INVERTED-F ANTENNA

BACKGROUND OF THE INVENTION

1. Field of the Invention

The present invention relates to a planar inverted-F antenna, and especially relates to a compact antenna applied to a wireless communication device, which can be automatically assembled and has an extremely stable structure.

2. Description of Related Art

With the progress of wireless communication technology, more and more electronic devices, such as notebook computers, PDAs or cellular phones, are installed with antennas, so that these electronic devices can be communicated with far-end devices. In these applications, PIFAs are popular as a built-in type or embedded type antenna for mobile communication products because they are light, thin and cost less.

Reference is made to FIG. 1, which shows a perspective view of a conventional PIFA 9. The PIFA 9 has a rectangular-shaped radiation element 91 and a grounding element 92. The grounding element 92 is spaced apart from and parallel to the radiation element 91. The radiation element 91 is extended downwardly with a ground leg 93 and a signal leg 94. The ground leg 93 is electrically connected to the grounding element 92. The signal leg 94 penetrates through the grounding element 92 and is electrically connected to a radio frequency transceiver (not shown) as a signal-feeding leg. When the radiation element 91 senses an external electromagnetic wave, a signal will be transferred to the radio frequency transceiver via the signal leg 94. The radio frequency transceiver enables the radiation element 91 to radiate an electromagnetic wave via the signal leg 94.

The ground leg 93 and the signal leg 94 of the conventional PIFA 9 are located very close together, and consequently the structure is unstable. Two pads 95 and 96 made of insulative material, such as foam or acrylic, are generally disposed between the radiation element 91 and the grounding element 92 for fixing the PIFA 9 and enhancing the structural strength so that it becomes more stable. Because the pads 95 and 96 cannot endure high temperature, the processes of assembling the pads 95 and 96 must take place after the PIFA 9 has been soldered. The pads 95 and 96 cannot be assembled on a PCB automatically and manual assembly is unavoidable. This type of PIFA not only increases the cost of production, but also slows down the manufacturing and assembly process.

In regard to improving the stability and structure of PIFAs, as well as the assembly process, U.S. Pat. No. 6,738,023 'MULTIBAND ANTENNA HAVING REVERSE FED PIFA' was published on May 18, 2005. The multiband antenna is supported by a plastic platform (plastic undercarriage) and is lifted by four metal legs for being soldered onto a PCB directly. The radiation element is placed on the plastic undercarriage, and the plastic platform is fabricated using Micro-Inserting-Molding technology. The legs are made of metal plate by punching, and embedded in the plastic platform during the molding process. This method however, has the disadvantages of complex manufacturing technology and high production costs.

Another prior art is U.S. Pat. No. 6,850,200 'COMPACT PIFA ANTENNA FOR AUTOMATED MANUFACTURING', published on Feb. 1, 2005. The antenna has a radiation element. The radiation element has signal legs on one end thereof. The other end of the radiation element has a non-conductive support structure. The support structure and the signal legs are designed in such a way that they support the radiation element together. This structure improves the stability of the antenna. Furthermore it allows the antenna to be automatically soldered into place. The support structure is made of an insulative material, such as Liquid Crystal Ploymer (LCP), which is able to withstand the heat of solder reflow, whereby it is possible to fix the support structure directly onto a PCB. As such, the antenna can be automatically assembled. Because the support structure's larger size compared to the prior art, the aforesaid conventional antenna has the disadvantage of increasing the area that suffers from a dielectric effect. A further disadvantage is the support structure's complex shape that requires a special material and thereby elevates the costs of production.

In view of the conventional inverted-F antennas, there is a need for improving upon the aforesaid disadvantages.

SUMMARY OF THE INVENTION

The present invention provides a planar inverted-F antenna that reduces production costs due to its easily manufactured structure. Furthermore, the antenna can also be soldered onto a PCB by surface mounted technology (SMT) to enhance the speed of assembly.

According to this invention, a planar inverted-F antenna is provided, which is fixed onto a PCB and includes a grounding element, a radiation element and a signal link element. The grounding element is made of conductive material and is plate-shaped. The radiation element is formed by punching a metal plate, and has a grounding leg and at least one supporting leg downwardly bending from an edge thereof. The grounding leg is electrically connected with the grounding element. The supporting leg and the grounding leg are substantially opposite to each other and soldered onto the PCB for supporting the radiation element together. The signal link element electrically connects the radiation element to a circuit for wireless signal transmission and reception.

According to another embodiment of this invention, a planar inverted-F antenna is provided, which is adapted for a Wi-Fi/Bluetooth module and fixed onto a PCB and includes a grounding element, a radiation element and a signal link element. The grounding element is made of conductive material and is plate-shaped. The radiation element is formed by punching a metal plate and has a first radiation portion and a second radiation portion connected with the first radiation portion. The first radiation portion has a grounding leg downwardly bending from an edge thereof. The grounding leg is electrically connected with the grounding element. The second radiation portion has a plurality of supporting legs. The supporting legs are soldered onto the PCB and, together with the grounding leg, support the radiation element. The signal link element electrically connects the first radiation element to a circuit for wireless signal transmission and reception.

BRIEF DESCRIPTION OF THE DRAWINGS

The various objects and advantages of the present invention will be more readily understood from the following detailed description when read in conjunction with the appended drawing, in which.

DETAILED DESCRIPTION OF THE PREFERRED EMBODIMENTS

Figure 1:
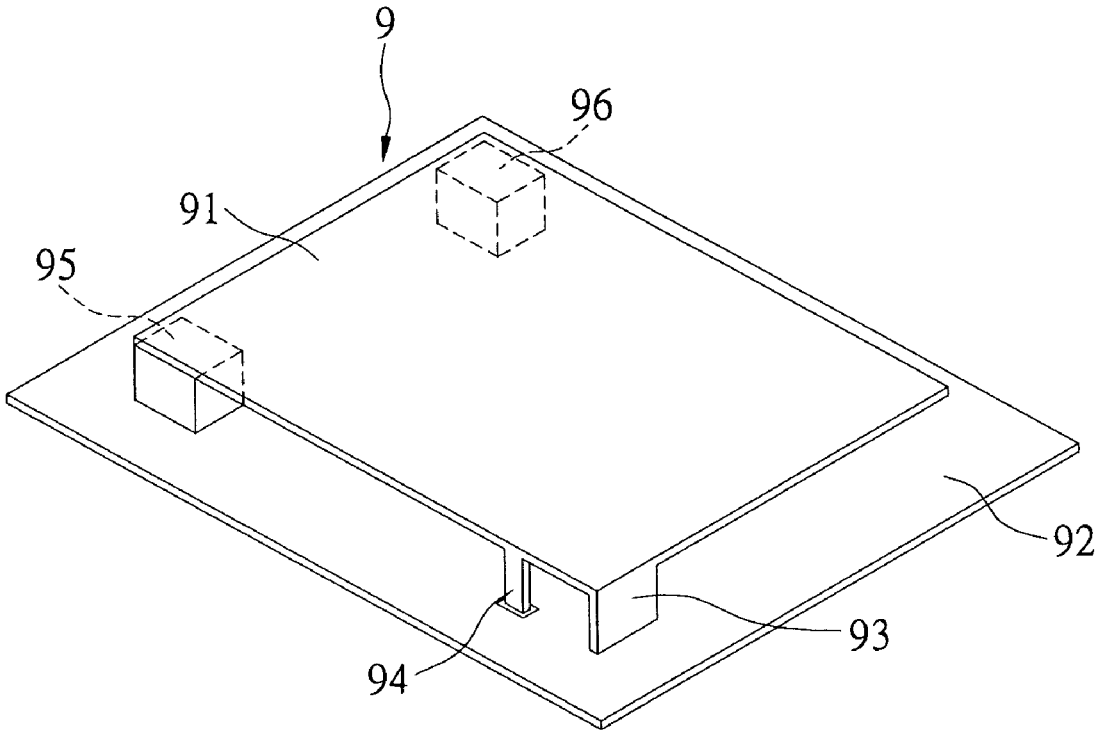
FIG. 1 PRIOR ART
FIG. 1 is a perspective view of a conventional PIFA.
Figure 2:
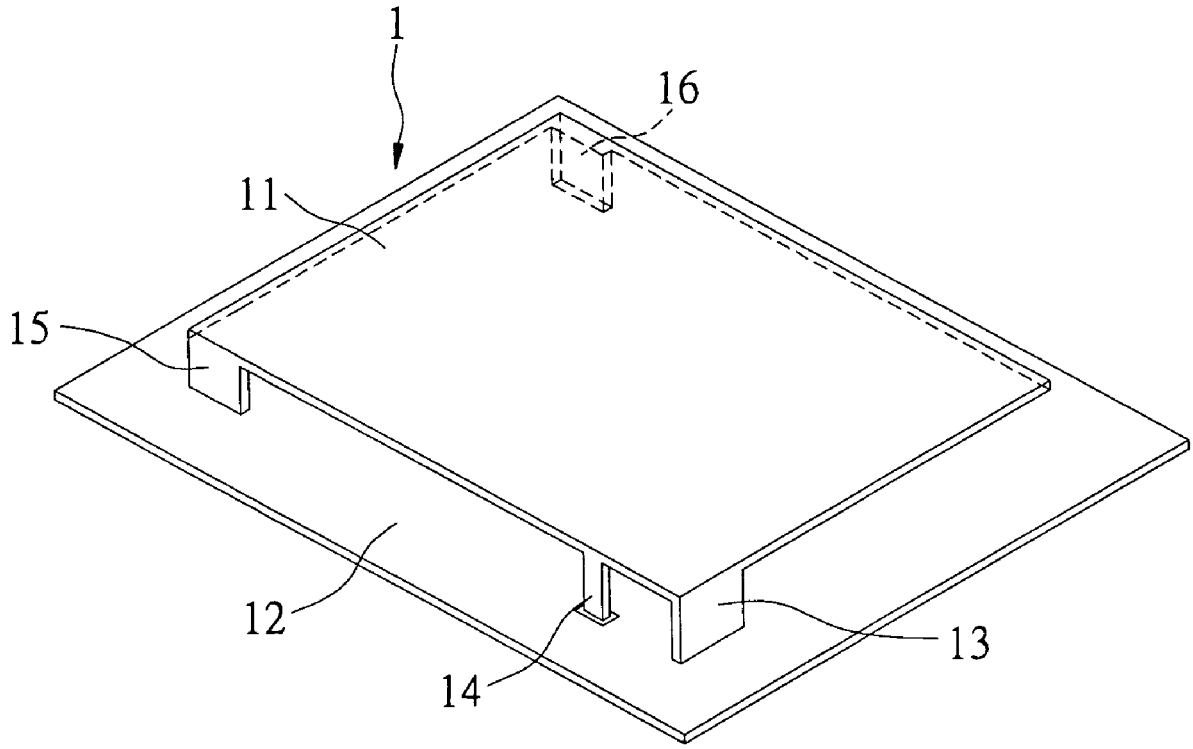
FIG. 2 is a perspective view of a PIFA of the first embodiment according to the present invention.

FIG. 2 illustrates a planar inverted-F antenna according to a first embodiment of the present invention. The present invention provides a planar inverted-F antenna 1 fixed onto a PCB (not shown in FIG. 2) and having a radiation element 11 and a grounding element 12.

The grounding element 12 is made of conductive material, such as copper, and is plate-shaped, which is generally embedded in the PCB.

The radiation element 11 is a metal plate, such as a copper plate, and has a grounding leg 13 downwardly bent from an edge thereof (generally referred to as a close end). The grounding leg 13 is electrically connected to the grounding element 12.

The planar inverted-F antenna 1 further has a signal link element for electrically connecting the radiation element 11 to a radio frequency transceiver (such as a circuit for wireless signal transmission and reception). In this embodiment, the signal link element includes a signal leg 14, which is extending downwardly from an edge of the radiation element 11 and fixed onto the PCB. A signal wire (not shown) is connected to an end of the signal leg 14 for electrically connecting to the radio frequency transceiver. The signal wire can be a coaxial cable line including a core conductor and a grounding layer that isolatedly covers the core conductor. The core conductor electrically connects the signal leg 14 to the radio frequency transceiver. The grounding layer is electrically connected to the grounding element 12.

However, the signal link element is not limited to the aforesaid embodiment. For example, only a connecting line, such as a coaxial cable for electrically connecting the radiation element 11 to the radio frequency transceiver can be used to replace the signal leg and the coaxial cable.

An important feature of the present invention is that there is at least one supporting leg downwardly extending from an edge of the radiation element 11. In this embodiment, there is a pair of supporting legs 15 and 16 extending downwardly from an edge of the radiation portion 11 far from the grounding leg 13 (generally referred to as an open circuit end) and fixed onto the PCB. The supporting legs 15 and 16 and the grounding leg 13 support the radiation element 11 together. For supporting the radiation element 11 stably, the supporting legs 15 and 16 of the present invention are substantially opposite to the grounding leg 13 and form a substantially triangular-shaped object. The supporting legs 15 and 16 preferably extend downwardly from a corner of the radiation element 11 far from the grounding leg 13. The supporting legs 15 and 16 can further have a soldering portion (not shown) bent from a bottom end thereof for increasing the potential soldering area and the overall stability of the device.

In the present invention, the shape of the radiation element 11 and the relative position of the supporting legs 15 and 16 and the grounding element 12 can be adjusted according to an operating band of the antenna. For example, a part of the radiation element 11 separately extends above the grounding element 12 and forms a clearance section beneath another part of the radiation element 11. Moreover, the radiation element 11 can be shaped in a polygonal shape and formed over two radiation elements.

According to the above-mentioned description, the radiation element 11 of the planar inverted-F antenna 1 is placed on the PCB. Sequentially, the planar inverted-F antenna 1 passes through a solder reflow oven, and then is directly soldered onto the PCB by means of SMT technology. Therefore, a process of disposing foam or acrylic pads for supporting the antenna can be omitted. After the planar inverted-F antenna 1 of the present invention is fixed, the structure becomes solid and stable. The supporting legs 15 and 16 are formed by stamping and bending a metal plate during the manufacturing process, so that it is manufactured easily and the total cost of production is lowered. Moreover, as the process allows for automatic assembly with the manual assembly process being omitted, labor costs can be reduced and the manufacturing speed is increased.

Figure 3:
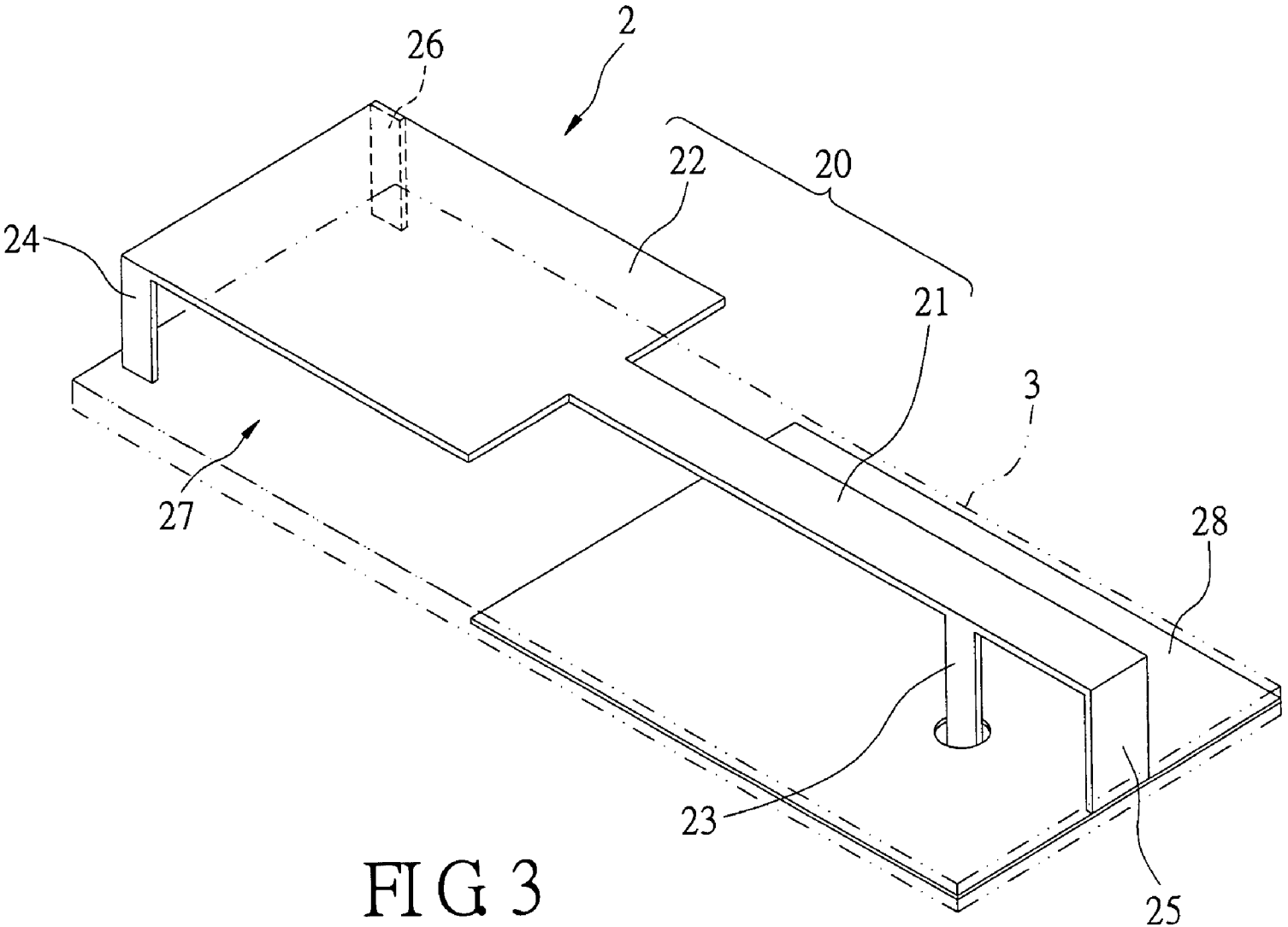
FIG. 3 is a perspective view of a PIFA of the second embodiment according to the present invention.

FIG. 3 illustrates a second embodiment of the planar inverted-F antenna. According to the aforesaid characteristics, the present invention provides a preferred embodiment of the planar inverted-F antenna 2 that is able to be adapted for a Wi-Fi/Bluetooth module. The preferred embodiment operates in 2.4~2.6 GHz frequency and can be applied as a Wi-Fi/Bluetooth module antenna. The planar inverted-F antenna 2 is fixed onto a PCB 3, and includes a radiation element 20 and a grounding element 28. The grounding element 28 is made of conductive material and plate-shaped, which is embedded in the PCB 3. The radiation element 20 is formed by punching a metal plate, and has a first radiation portion 21 and a second radiation portion 22 connected with the first radiation portion 21.

In this preferred embodiment, the first radiation portion 21 has a grounding leg 25 downwardly bending from an edge thereof that is disposed far from the second radiation portion 22. The grounding leg is electrically connected to the grounding element 28. The second radiation portion 22 of the radiation element has a plurality of supporting legs protruding from edges thereof. There is a pair of supporting legs 24 and 26 soldered onto the PCB 3, thereby supporting the radiation element with the grounding leg 25 together. The supporting legs 24 and 26 extend downwardly from an edge of the second radiation portion 22 far from the grounding leg 25 and are soldered onto the PCB 3.

The planar inverted-F antenna 2 also has a signal link element electrically connecting the radiation element to a radio frequency transceiver. In this embodiment, the signal link element includes a signal leg 23 that is extended downwardly from an edge of the first radiation element 21 and penetrating through the PCB 3. The signal leg 23 is electrically connected to the radio frequency transceiver via a signal line (not shown).

In this preferred embodiment, the radiation element is substantially T-shaped. The first radiation portion 21 has a narrow rectangular-shape, and the second radiation portion 22 has a rectangular-shape. The grounding element 28 extends toward the grounding leg 25 from a connecting portion of the first radiation portion 21 and the second radiation portion 22, and is only beneath the first radiation portion 21. In other words, the PCB 3 extends beneath the second radiation portion 22 and defines a clearance section 27 between the second radiation portion 22 and the PCB 3. In this embodiment, an engineer can adjust the clearance section 27 in order to adjust an operational bandwidth.

Figure 4:
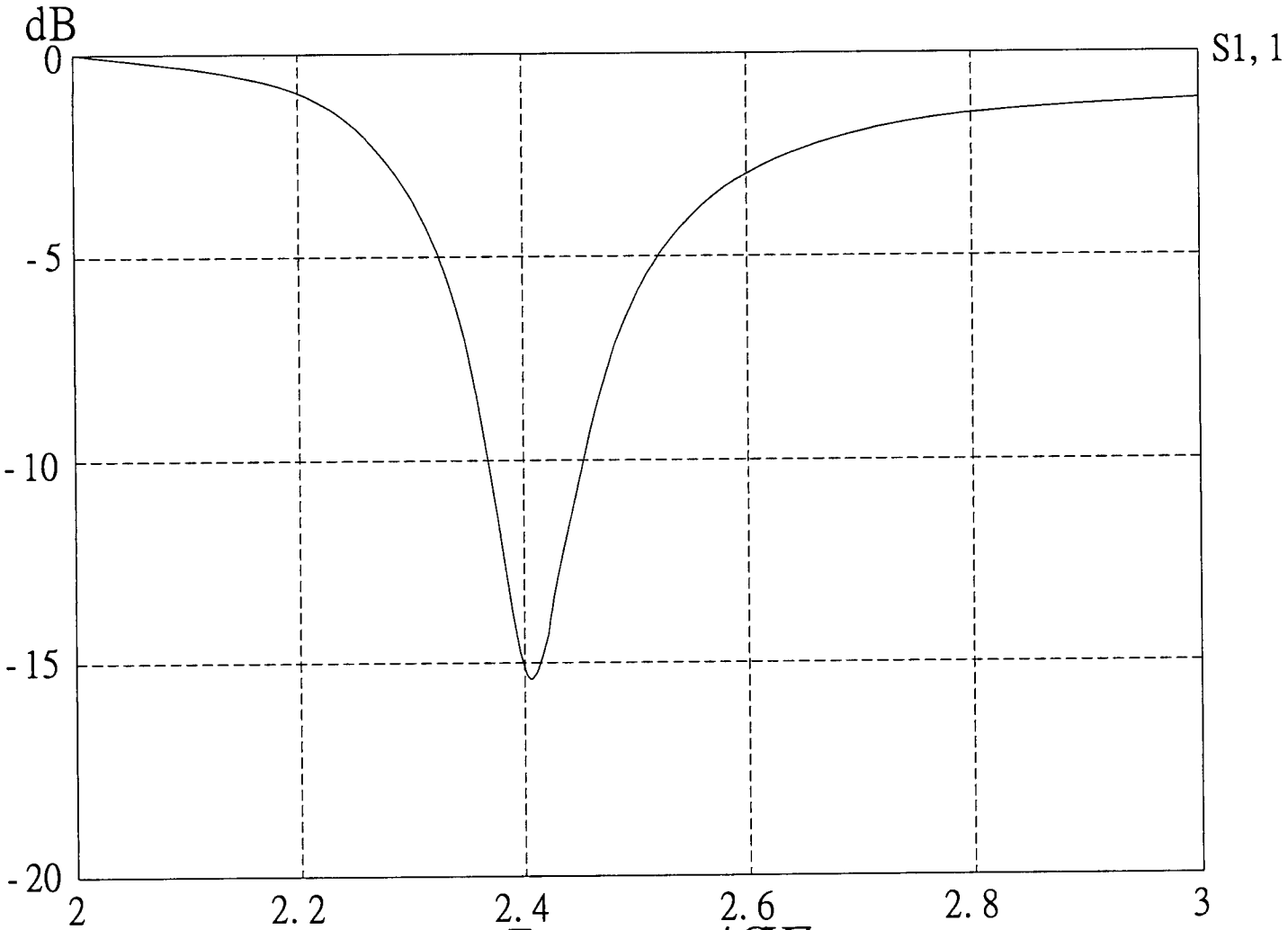
FIG. 4 is a diagram of an S11-parameter return loss of the second embodiment in FIG. 3 according to the present invention.

This preferred embodiment has the advantages of an easy manufacturing process for the antenna, a stable structure and an automated soldering and assembly process. Moreover, the pair of supporting legs 24 and 26 functions as an inductance and can further reduces resonant frequency. Reference is made to FIG. 4, which is a diagram of an S11-parameter return loss of the embodiment in FIG. 3. The parameter value of the return loss means the condition of a system signal sent to an antenna, or the condition of a reflected system signal at the inputting end compared with the condition of a reflected system signal at the receiving end. When the return loss value is lower, the reflected energy is lower. In other words, most of the energy is radiated to air via the antenna. Analysis of the embodiment via simulated software shows that when the frequency is at about 2.46 GHz the return energy is at its lowest value of about −15 dB.

Figure 5:
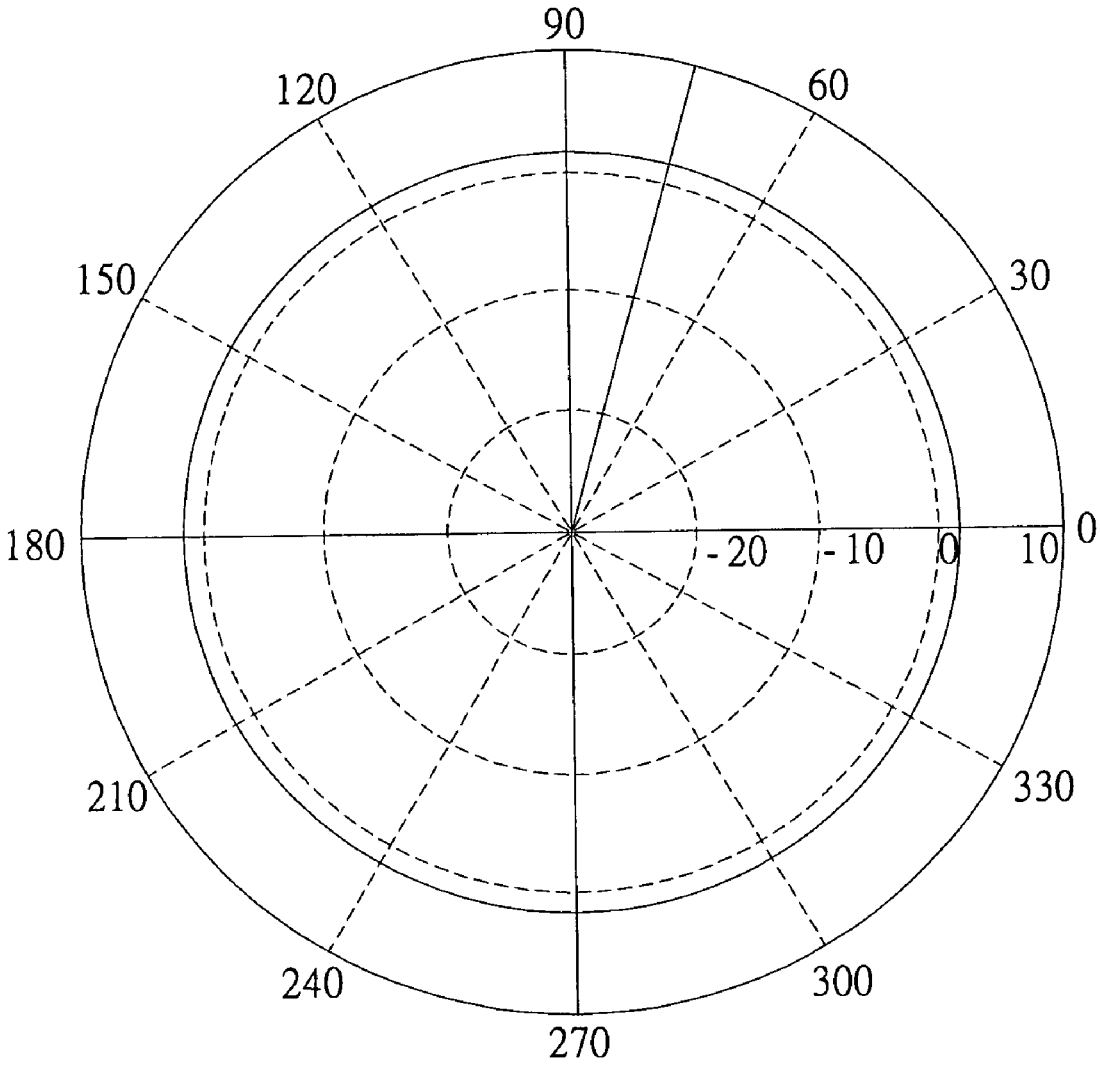
FIG. 5 shows a radiation pattern on the X-Z plane of the second embodiment in FIG. 3 according to the present invention.
Figure 6:
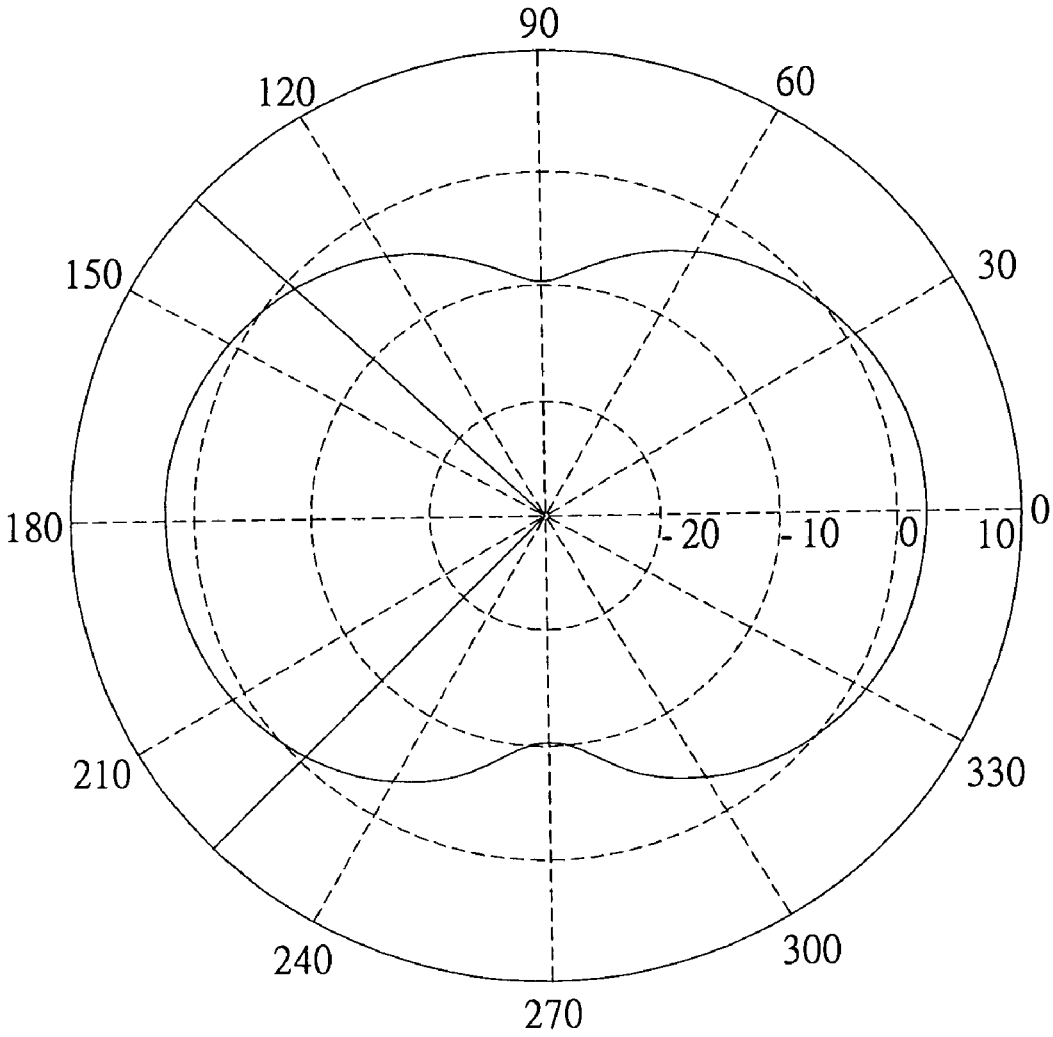
FIG. 6 shows a radiation pattern on the X-Y plane of the second embodiment in FIG. 3 according to the present invention.

Reference is made to FIGS. 5 and 6, which illustrate the electrical characteristics of the embodiment of FIG. 3. The radiation pattern is close to a ball-shaped object. FIG. 5 shows the radiation pattern on an X-Z plane and illustrates the preferred embodiment has the advantage of being isotropic on the horizontal (X-Z) plane (parameters: frequency=2.46 GHz, main lobe magnitude=1.9 dBi, main lobe direction=180.0 deg., angular width=88.3 deg.). FIG. 6 shows the radiation pattern on an X-Y plane and illustrates the preferred embodiment canceling out the notches on an X-Y plane (parameters: frequency=2.46 GHz, main lobe magnitude=1.5 dBi, main lobe direction=75.0 deg.).

Figure 7:
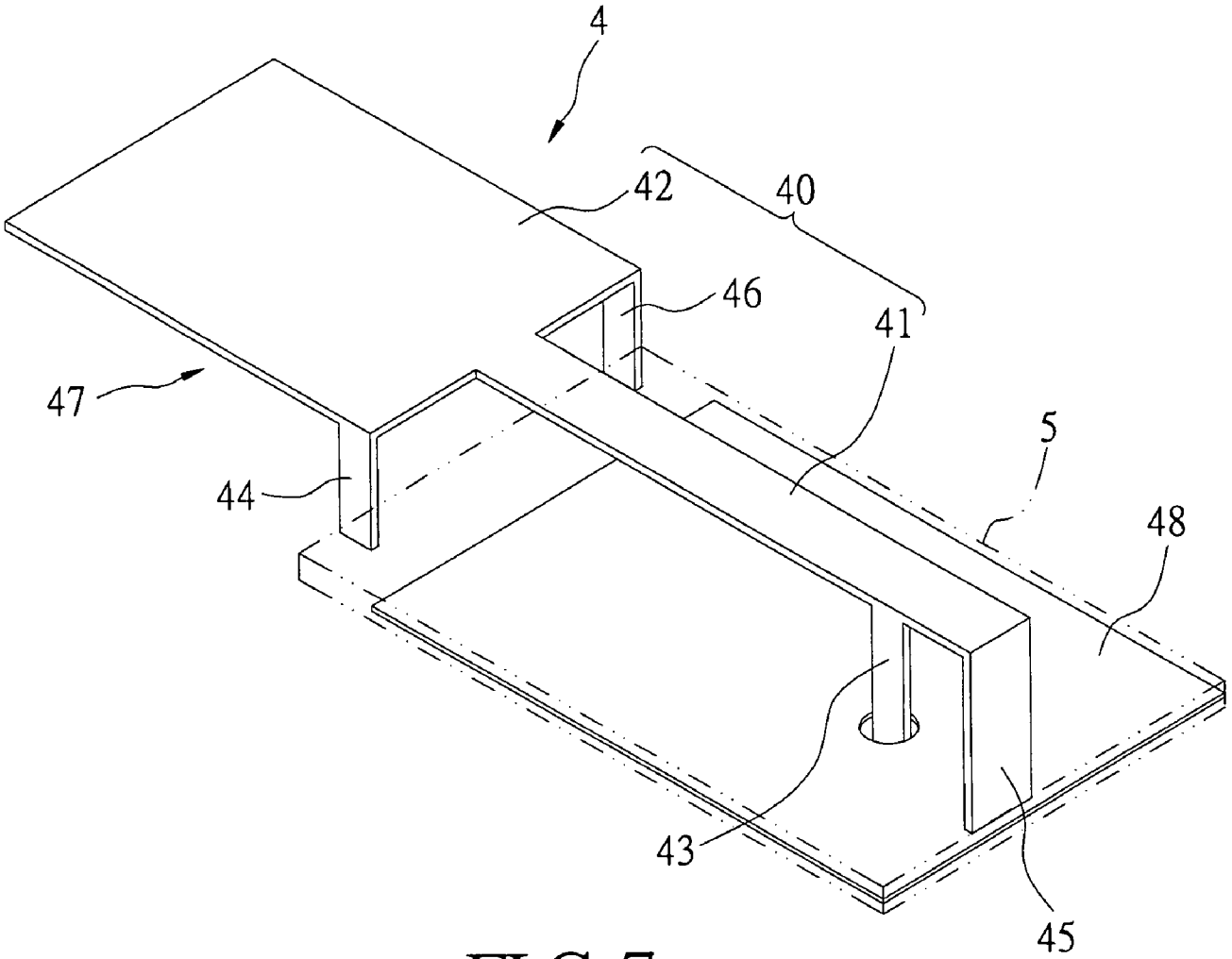
FIG. 7 is a perspective view of a PIFA of third embodiment according to the present invention.

FIG. 7 illustrates a third embodiment of the planar inverted-F antenna according to the present invention. This embodiment provides a planar inverted-F antenna 4 including a radiation element 40 and a grounding element 48. The radiation element 40 has a first radiation portion 41 and a second radiation portion 42. The second radiation portion 42 extends beyond an edge of the PCB 5. The first radiation portion 41 has a grounding leg 45 that is electrically connected to the grounding element 48, and a signal leg 43 extended downwardly and penetrated through the PCB 5. The signal leg 43 is electrically connected to a radio frequency transceiver. The planar inverted-F antenna 4 has a pair of supporting legs 44 and 46 that extend downwardly from an edge of the second radiation portion 42 adjacent to the first radiation portion 41. The advantage of this embodiment is that a clearance section 47 under the second radiation portion 42 can be deployed to co-operate with an electronic device.

Figure 8:
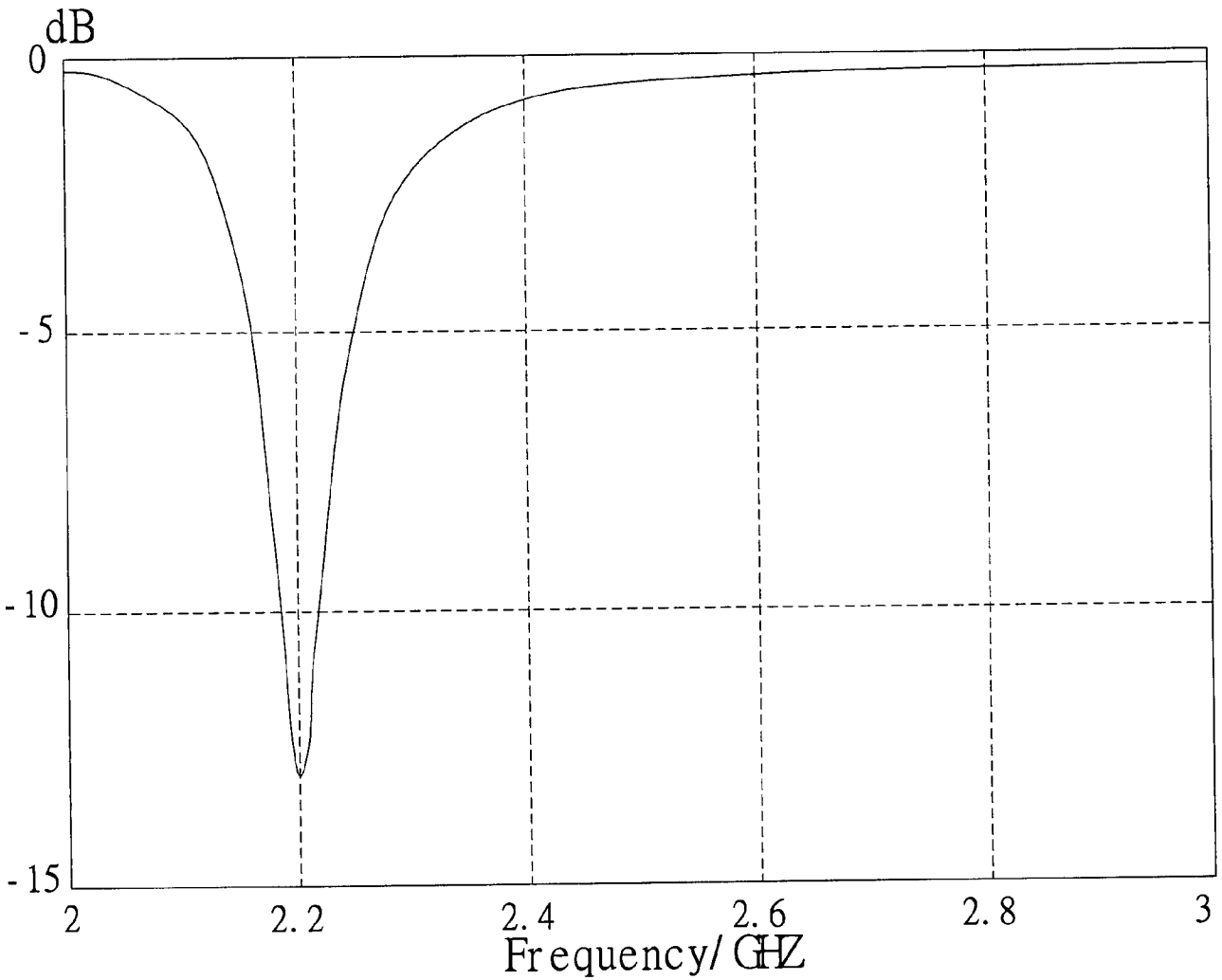
FIG. 8 shows a diagram of a return loss of the third embodiment as shown in FIG. 7 according to the present invention.

FIG. 8 illustrates a diagram of return loss of the embodiment in FIG. 7. Analysis of this embodiment via simulated software shows that when the frequency is at about 2.2 GHz, the return energy is lowest being about −13 dB.

A summary of the characteristics and advantages of the present invention is as follows:

1. The present invention is manufactured easily; the cost of manufacturing the antenna is almost equal to the cost of the metal plate itself. Whereby the production costs are reduced.

2. The present invention is adapted for automated assembly and uses surface mounted technology (SMT) to solder the antenna directly onto the PCB for enhancing the speed of assembly.

3. The present invention does not need insulative pads, so that the process of disposing of the pads is omitted and labor costs are reduced.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A planar inverted-F antenna adapted for a Wi-Fi/Bluetooth module and fixed onto a PCB, comprising:

a grounding element that is made of conductive material and is plate-shaped;

a radiation element formed by punching a metal plate, and having a first radiation portion and a second radiation portion connected with said first radiation portion, said first radiation portion having a grounding leg downwardly bent from an edge thereof, said grounding leg electrically connected with said grounding element, said second radiation portion having a plurality of supporting legs, said supporting legs being soldered onto said PCB and supporting said radiation element with said grounding leg together, wherein said radiation element is substantially T-shaped, and wherein said first radiation portion has a narrow rectangular-shape and said second radiation portion is rectangular-shaped, said grounding element extended toward said grounding leg from a connecting portion of said first radiation portion and said second radiation portion; and a signal link element electrically connecting said radiation element to a circuit for wireless signal transmission and reception.

2. The planar inverted-F antenna as claimed in claim 1, wherein said grounding element is embedded in said PCB.

3. The planar inverted-F antenna as claimed in claim 1, wherein said PCB extends beneath said second radiation portion and defines a clearance section between said second radiation portion and said PCB.

4. The planar inverted-F antenna as claimed in claim 3, wherein said plurality of supporting legs extend downwardly from an edge of said second radiation portion far from said grounding leg and fixed onto said PCB.

5. A planar inverted-F antenna adapted for a Wi-Fi/Bluetooth module and fixed onto a PCB comprising:

a grounding element that is made of conductive material and is plate-shaped;

a radiation element formed by punching a metal plate, and having a first radiation portion and a second radiation portion connected with said first radiation portion, said first radiation portion having a grounding leg downwardly bent from an edge thereof, said grounding leg electrically connected with said grounding element, said second radiation portion having a plurality of supporting legs, said supporting legs being soldered onto said PCB and supporting said radiation element with said grounding leg together, said second radiation portion extending beyond an edge of said PCB;

a signal link element electrically connecting said radiation element to a circuit for wireless signal transmission and reception.

6. The planar inverted-F antenna as claimed in claim 5, wherein said plurality of supporting legs extend downwardly from an edge of said second radiation portion adjacent to said first radiation portion and fixed onto said PCB.

* * * * *